US005642254A

United States Patent [19]

Benwood et al.

[11] Patent Number: 5,642,254

[45] Date of Patent: Jun. 24, 1997

[54] HIGH DUTY CYCLE AC CORONA CHARGER

[75] Inventors: Bruce R. Benwood, Churchville; John W. May; Martin J. Pernesky, both of Rochester, all of N.Y.

[73] Assignee: Eastman Kodak Company, Rochester, N.Y.

[21] Appl. No.: 613,647

[22] Filed: Mar. 11, 1996

[51] Int. Cl.[6] ..... G03G 15/02

[52] U.S. Cl. ..... 361/235; 399/89

[58] Field of Search ..... 355/200, 221, 355/222; 361/229, 230, 235; 399/89; 430/902

[56] References Cited

U.S. PATENT DOCUMENTS

| | | | |
|---|---|---|---|
| 3,699,335 | 10/1972 | Giaimo, Jr. | 250/49.5 |
| 4,038,593 | 7/1977 | Quinn | 323/4 |
| 4,166,690 | 9/1979 | Bacon et al. | 355/3 |
| 4,526,848 | 7/1985 | Okada et al | 430/902 X |
| 4,731,633 | 3/1988 | Foley et al. | 355/3 |
| 4,910,400 | 3/1990 | Walgrove | 250/324 |
| 5,539,501 | 7/1996 | Yu et al. | 355/221 |

*Primary Examiner*—Joan H. Pendegrass
*Attorney, Agent, or Firm*—Nelson A. Blish

[57] ABSTRACT

This invention pertains to an AC charger (10) in which an AC voltage waveform applied to a corona wires (12) has a duty cycle of between 50% and 90%. This increases the efficiency of the charger without increasing the signal-to-noise ratio. In one embodiment, the AC voltage waveform is asymmetric.

29 Claims, 7 Drawing Sheets

CONSTANT CURRENT MODE FOR 50% & 67% DUTY CYCLES

HIGH DUTY CYCLE AC CORONA CHARGER

BACKGROUND OF THE INVENTION

1. Field of the Invention

This invention pertains to AC corona chargers in general and in particular to AC corona chargers wherein an asymmetric voltage waveform is applied to the corona wires.

2. Description of the Prior Art

In an electrophotographic copying system, a photoconductive element is moved past a corona charger which applies a uniform, electrostatic charge to the photo conductive element. After leaving the vicinity of the corona charger, the photoconductive element moves past an exposure system at which it is exposed to a light image of an original, to cause the charge to be altered in an imagewise pattern to form a latent image charge pattern. Following exposure, the latent image charge pattern is developed by application of toner particles to the photoconductive element to create a toned image. Finally, this image is transferred from the photoconductive element to a receiver sheet and fused to form a permanent image.

AC charging typically uses a corona wire charger having a symmetrical AC voltage applied to the corona wires, superimposed on a DC offset voltage. A conventional AC charger operates at a 50% duty cycle, which is defined to mean that the time duration of the positive excursion of the AC component of the voltage waveform is equal to the time duration of the negative excursion. In general, duty cycle is defined as the percentage of time an AC component of the voltage waveform has a first polarity, compared to the time for one complete cycle. The AC component used for prior art charging is symmetrical and has essentially the same shape for both positive and negative excursions, e.g., sinusoidal, square, trapezoidal, or triangular waveforms. Typically, the maximum amplitudes of the positive and negative excursions of the AC voltage component are equal.

A grid is often used to control the surface potential of the photoconductor. The charging current is that current transmitted by the grid. It is well-known that grid-controlled AC corona chargers are considerably less efficient than grid-controlled DC corona chargers. The reason for this is that for a typical AC charger with grid control, the corona wire has the same polarity as the grid for only part of each cycle of the waveform. For an uncharged photoconductor element, charging current is only transmitted to the photoconductor in that portion of the AC waveform in which the emission current from the corona wire and the grid have the same polarity. Thus, charging is effectively in a pulsed DC mode. Charging continues in this mode until the surface potential of the photoconductor element approaches the potential of the grid. Typically, when the magnitude of the surface potential of the photoconductor is about 100 volts less than the grid potential, current of polarity opposite to that of the grid starts to be transmitted to the photoconductor element. As charging continues, the charging current contains an increasing proportion of current of opposite polarity, in an AC mode. When the photoconductor element is fully charged, the two components of current are equal.

Uniformity of charging is closely related to the uniformity of corona current emitted along the length of a corona wire. Charging uniformity is normally much higher with AC charging than with DC corona charging. For example, negative AC charging using a grid, at 50% duty cycle is significantly less noisy than negative DC charging. DC emitted currents typically show significant fluctuations at each position on a corona wire. These fluctuations are usually considerably worse with negative corona discharges than with positive corona discharges. Moreover, the sites of these fluctuations and their intensities may not be fixed spatially, but move around, or flicker, from place to place. Charging uniformity can be adversely affected by these fluctuations, resulting in unwanted density fluctuations or streaks in toned images, especially for negative charging. It would be desirable to have a corona charger with the efficiency of a DC charger and the uniformity of an AC charger.

U.S. Pat. No. 4,910,400 discloses a programmable DC charger with a high voltage corona wire between an electrode and a photoconductor. A voltage pulse is applied to the electrode, of the same polarity as the DC voltage applied to the corona wire, such that the corona charge produced by the wire is periodically accelerated by the electrode. The duty cycle of the pulsed voltage applied to the electrode controls the on-off time of the corona charger. U.S. Pat. No. 4,166,690 describes a power supply in which a digital regulator, in conjunction with at least one pulse width modulated power supply, permits fast rise times of the power supply current. This is useful in defining an interframe edge. U.S. Pat. No. 4,731,633 describes a corona charger, for positive charging, without a grid, in which a negative polarity voltage pulse is applied periodically to the corona wire for the prevention of positive streamer discharges, or "sheeting". This negative polarity voltage pulse is applied to the corona wire "in a manner having minimal effect on charging functions," for example, during the cycle-up period, cycle-out period, and standby period. An example is given in which a negative pulse duration of 20 ms follows a positive current signal pulse duration of 180 ms. This is equivalent to a positive duty cycle of 90%. This waveform has a frequency of 5 Hz, which is far outside of the usual range of AC operation and is used for operation between frames. U.S. Pat. No. 4,038,593 is for an AC power supply with regulated DC bias current. The duty cycle of the AC waveform is constrained, such that the time average of the voltage signal is essentially zero, i.e., the polarity of the voltage waveform which has a shorter duration has a higher amplitude. The regulation of the DC bias current is achieved without the use of a grid by varying the duty cycle. The DC bias current controls the level of charge on the photoconductor. U.S. Pat. No. 3,699,335 is for an apparatus that energizes a corona wire with voltage pulses of constant amplitude. The width or frequency of the pulses is controlled in response to an error signal to regulate the applied charge.

SUMMARY OF THE INVENTION

It is the object of the present invention to provide a means for improving the charging efficiency of AC corona wire chargers, while maintaining the uniformity of AC charging, especially for negative charging. It is another objective of the invention to provide means for improving the performance reliability of AC corona wire chargers.

The present invention uses an AC corona wire charger, method and apparatus, in which the AC component of the voltage waveform applied to the corona wires has a duty cycle greater than 50%, and the potential on the corona wire is greater than a threshold voltage for corona emission for each polarity. In one embodiment the absolute value of the time integrated AC component of the voltage on the corona wire is greater than zero. For negative charging of a photoconductor element, duty cycle greater than 50% means the negative portion of each AC cycle has a time duration greater than the time duration of the positive portion of the AC cycle. For example, in a hypothetical AC negative charging system with a square wave, a negative duty cycle of 80% represents an AC signal in which the time duration of the negative excursion is four times longer than the duration of the positive excursion. Conversely, for positive charging with a positive duty cycle of greater than 50%, the positive portion of each AC cycle has a time duration greater than the time duration of the negative portion. In one embodiment, a DC bias or offset voltage, negative for negative charging, and positive for positive charging, is added to the AC voltage signal.

In one embodiment of the invention, negative AC charging is done with a trapezoidal waveform and a negative duty cycle of approximately 70% to 80%, with peak amplitudes of the AC component of the voltage waveform the same. This embodiment increases the negative charging current and reduces effective impedance, thereby increasing the charging efficiency. This is also accompanied by an unexpected result, that the crosstrack charging current uniformity remains surprisingly high. As a result, efficient negative charging can be obtained at high negative duty cycles, with effective impedance almost as low as that of negative DC charging, but without incurring the high degree of non-uniformity typically found using negative DC chargers. Similarly, for positive charging, increasing the positive duty cycle lowers the effective impedance while maintaining superior charging current uniformity.

In another embodiment of the invention, negative AC charging is done with a duty cycle greater than 50%, such that the time-integrated charging current is the same as that from a charger operated at 50% duty cycle. This is accomplished by lowering the peak voltage amplitudes of the AC component of the voltage waveform. For example, with negative charging, the peak negative excursion of the wire potential is reduced as the negative duty cycle is increased, thereby reducing the emission current at the wires and so reducing the instantaneous current transmitted by the grid. For 70% duty cycle operation, the reduction in peak voltage is approximately 700 volts. By working at lower peak wire voltage, the possibility of a wire-to-grid arc is reduced, thereby improving the performance reliability of the charger. In addition, lower peak voltage allows the use of a less expensive, more reliable AC corona power supply.

BRIEF DESCRIPTION OF THE DRAWINGS

FIG. 9(*b*) shows graphs of probe current versus duty cycle.

DETAILED DESCRIPTION

Figure 1:
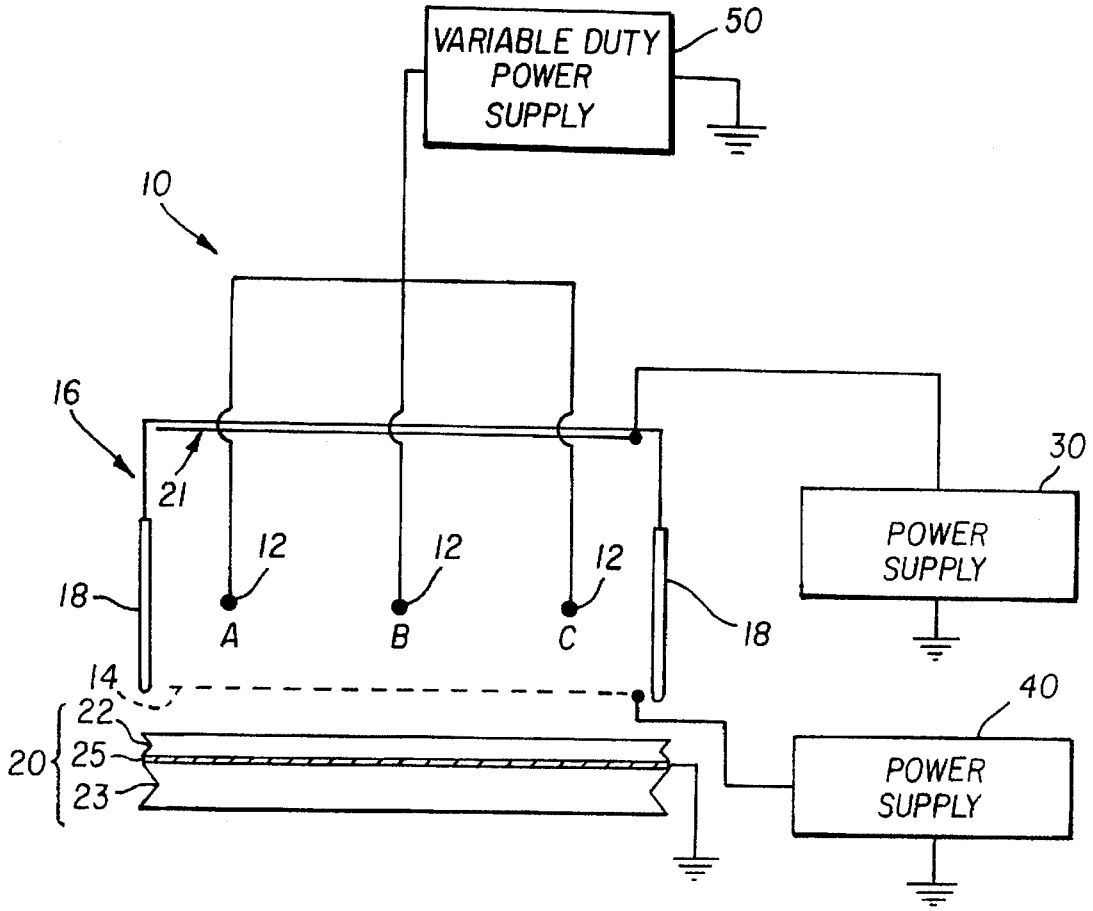
FIG. 1 is a schematic view of a high duty cycle AC corona charger according to the present invention.

A variable duty cycle AC charger, referred to in general by numeral 10, is shown schematically in FIG. 1. Charger 10 has corona wires 12, a grid 14, and a shell 16. Use of grid 14 is generally preferred, but it maybe removed for some applications.

Shell 16 has incomplete sidewalls which may be extended with sideshields 18. Sideshields 18, when employed, end at a preselected distance from the surface of photoconductive element 20. In a preferred embodiment, the preselected distance is approximately 1 mm. Sideshields 18 and shell 16 are preferably constructed of insulating plastic.

The preferred photoconductive element 20 consists of a photosensitive layer 22, a grounded conductive layer 23, and a base 25. The photoconductive element may be in the form of a dram or a web.

A conductive floor electrode 21 is located between shell 16 and wires 12 but is not necessary for the practice of the invention. Electrode 21 is connected to a power supply 30, however in other embodiments, electrode 21 may be grounded without affecting the utility of the invention. Shell 16, or sideshields 18, or both, may be lined with conductive material (not shown) and electrically connected to floor electrode 21. In some embodiments, the entire shell 16 may be constructed of conducting material and connected to power supply 30, or it may be grounded.

Power supply 40 maintains the potential of grid 14 at a preselected level. For example, the grid voltage may be set at −600V, however this value depends on the geometry of the charger, components used in the charger, and the charging requirements.

Variable duty cycle power supply 50 generates a high voltage AC signal applied to the corona wires 12. The duty cycle of the AC voltage signal applied to corona wires 12 is greater than approximately 50% and preferably less than approximately 90%, regardless of the polarity of charging. A duty cycle of 80% has been found to yield excellent results. A typical value of the AC voltage signal is ±8,000 volts, at 600 Hz. Again, this voltage and this frequency may be varied depending on other operating specifications and components. For example, frequency may be in the range of approximately 60Hz to 6,000 Hz and voltage may be in the range of 5,000 volts to 12,000 volts.

In the practice of this invention, the potential on the corona wire is greater than a threshold voltage for corona emission for each polarity. In the preferred embodiment, the AC component of the voltage signal applied to the corona wires has a trapezoidal waveform, although other waveforms may be useful in the practice of the invention.

In a first mode of operation, a grid 14 is used, electrode 21 is absent, and sideshields 18 are also absent. This mode is preferred, primarily because it minimizes the risk of arcing. It is used in Example 4 below.

In a second mode of operation, a grid 14 is used, floor electrode 21 is absent and plastic sideshields 18 are used. This mode is used in Examples 1–3 below. The performance in this mode is similar to that of the first mode, but because the impedance is somewhat higher, it is less preferred.

In a third mode of operation, a grid 14 is used, floor electrode 21 is installed, and sideshields 18 are absent. This mode is used in Examples 7 and 8, while Example 6 compares results when electrode 21 is either grounded or floating. In this mode, it is preferred that electrode 21 be grounded.

In a fourth mode of operation, a grid 14 is used, and sideshields 18 are lined with conductive material which is electrically connected to floor electrode 21. This mode is used in Example 7. This mode, although not the most preferred, has certain advantages because it allows lower peak voltages to be applied to the corona wires for the same impedance, and gives good charging uniformity results.

In a fifth mode of operation a grid is absent and the absolute value of the time integrated AC component of the voltage on the corona wire is greater than zero. The latter constraint means, considering an approximately rectangular waveform as an example, the voltage times the time in the positive excursion plus the voltage times the time in the negative excursion, is different from zero. One method of practicing the invention in a copying machine, for example, is to use a control grid and to fix the duty cycle at a pre-determined value. The grid is then used as a process control element by adjusting its potential to keep the surface potential of the charged photoconductor at a pre-determined voltage at the end of the charging process.

Figure 2:
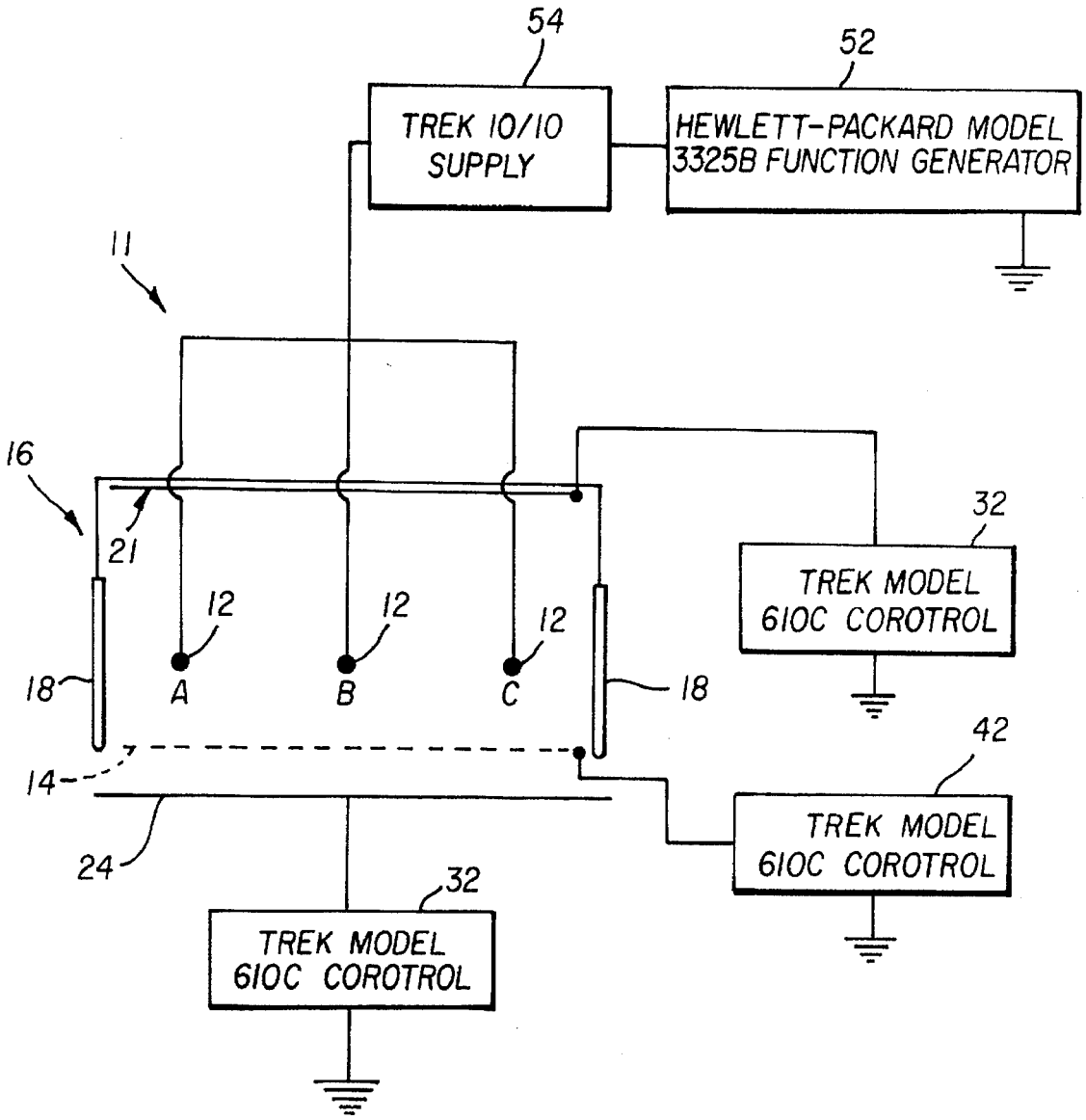
FIG. 2 is a schematic view of a test apparatus for a corona charger according to the present invention.

FIG. 2 is a schematic illustration of a test apparatus 11 used to gather data to show that an AC corona charger 10, with a high duty cycle AC voltage signal, exhibits improved efficiency. In the test apparatus, a low voltage AC signal was generated by a Hewlett-Packard Model 3314A function generator 52, which was amplified by a Trek Model 10/10 high voltage amplifier power supply 54. The output of power supply 54 was used to energize the corona wires 12 of the 3-wire corona charger 10. The waveform, the amplitude, the DC offset potential, and the duty cycle were set by the function generator 52. A square wave voltage signal at a frequency of 600Hz was used in the experiment. Owing to the finite slew rate of the Trek 10/10 power supply, a trapezoidal waveform, rather than an actual square wave, was produced at the corona wires 12. At 50% duty cycle, approximately 89% of the voltage of each positive or negative excursion was at peak. Potential at the grid 14 was provided by a Trek Model 610B Corotrol power supply 42. In those examples in which a floor electrode 21 was used, the floor electrode was powered by another Trek 610B Corotrol supply 32.

In those examples in which a grid was used, the spacing between the grid and the grounded plate electrode was set at the same value as the spacing used for charging a photoconductor. The wire-to-grid spacing used was 1 cm, and the wire-to-floor electrode spacing was 2 cm, with an interwire distance of 2 cm. The grid-to-plate spacing was approximately 60 mil (1.5 mm) for the experiments, except for Example 4. Typically, ambient conditions for the experiments were: relative humidity 40–60%, temperature 70°–75° F.

The plate electrode 24, shown in FIG. 2, 3 and 4 simulates an uncharged photoconductor, and was used for measuring large area plate currents to estimate initial charging impedances in Examples 1 and 3 below. Currents were measured with a Trek Model 610C Corotrol unit 32.

It is useful to characterize charging current uniformity by measuring the charging current as a function of distance parallel to the corona wires, i.e., in a cross-track direction in a copier machine. The standard deviation of the mean charging current divided by the mean current is a noise-to-signal ratio defined as the cross-track charging current non-uniformity, which may be expressed as a percentage. In all of the Examples below, the noise to signal ratio or non-uniformity of the emitted current was measured parallel to the length of the corona wires.

Figure 3:
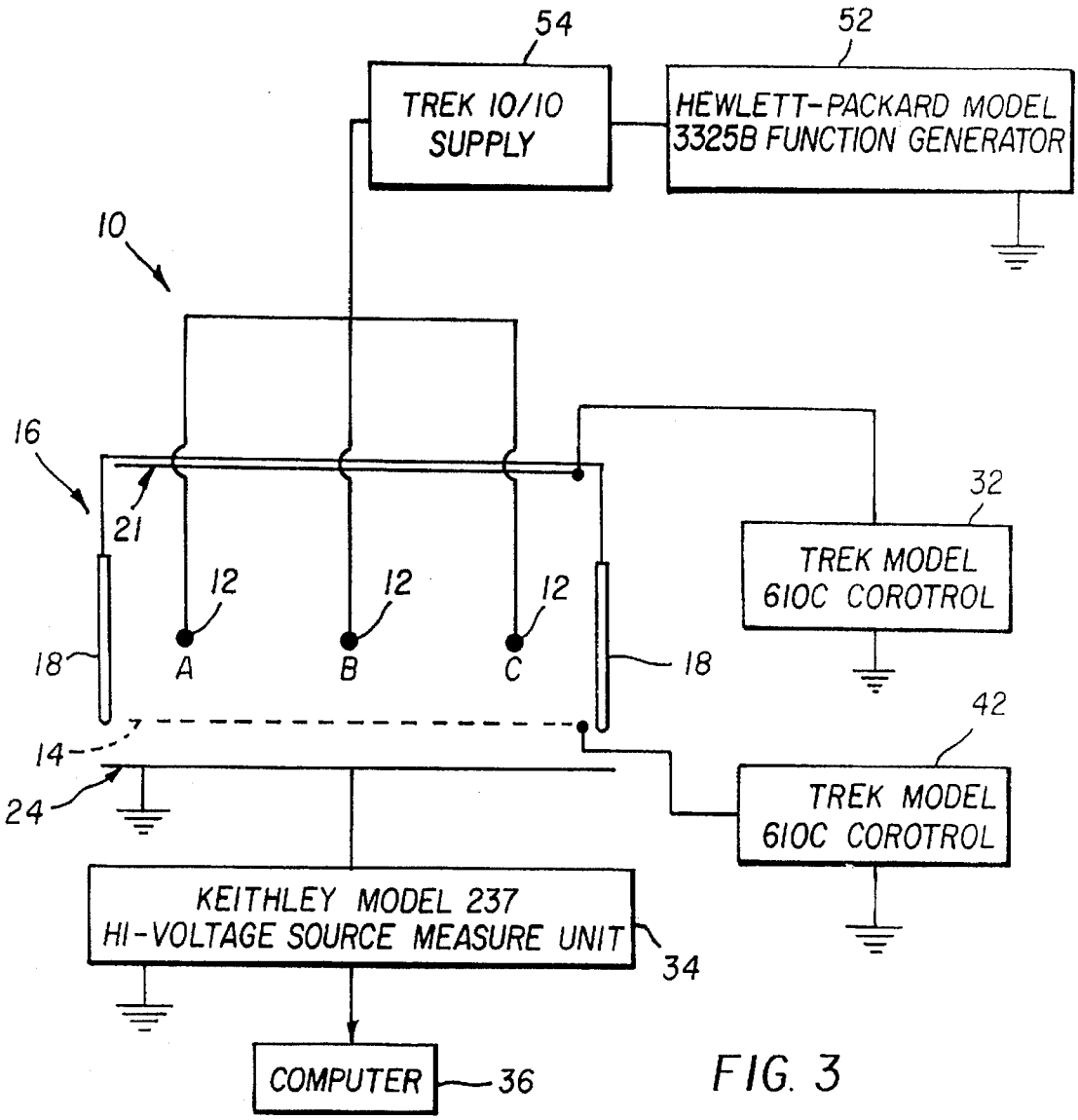
FIG. 3 is a schematic view, of an alternate test apparatus for a corona charger according to the present invention.
Figure 4:
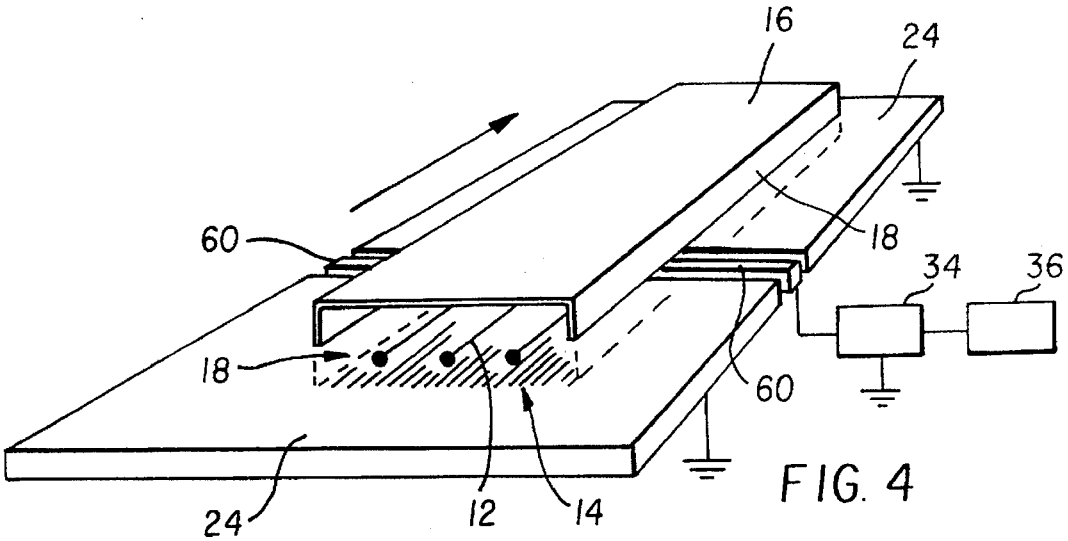
FIG. 4 is a perspective view of the test probe and plate of the apparatus of FIG. 3.

Noise-to-signal ratio was measured with the apparatus of FIG. 3 using the scanning probe 60, shown in FIG. 4. The length of the scanning probe 60 was equal to the width of the corona charger, and measured all three wires simultaneously. Scanning probe 60 consisted of a thin collector electrode, at ground potential, one millimeter wide, inserted in a narrow slit 26 cut in the grounded plate electrode 24, with the slit perpendicular to the corona wires.

The output of the Keithley Model 237 Source Measurement Unit 34 was sent to a computer 36. Digitized records of current scans were obtained, with 1000 address points corresponding to the entire length of the corona wires. Mean scanning probe currents and standard deviations of these currents were computed from the digitized records.

"Improvement of uniformity", as used in the experimental results, means a reduction in the standard deviation of the probe current along the entire wire length. It can be shown that the crosstrack deviation of standard output voltage on a charged photoconductor as it exits the charging station of a typical copy machine is proportional to the standard deviation of the scanned current as measured by the scanning probe 60, divided by the mean current. Hence, the use of a scanning probe to measure the fluctuations of current transmitted by the grid is a useful predictor of the output uniformity performance of the AC charger.

EXAMPLE 1

HIGH DUTY CYCLE LOWERS IMPEDANCE (INCREASES EFFICIENCY) WITHOUT LOWERING CHARGING UNIFORMITY

Measurements of negative AC charging effective impedance were made from the initial slopes of graphs of charging current versus plate voltage, and measurements of crosstrack charging current non-uniformity were made as a function of negative duty cycle for a fixed peak AC voltage of ±8 KV, with DC offset=0. In this example, a floor electrode was not used, and the shell of the charger was insulating plastic. The grid voltage $V_g$ was −600 V throughout, and the grid-to-grounded plate electrode spacing was 0.060". Tungsten wires with a diameter of 0.033" were used. Preliminary measurements using +8 KV and −8 KV DC corona charging showed that under these conditions, the positive and negative DC emission currents were approximately equal.

TABLE 1

NEGATIVE CHARGING AT CONSTANT PEAK POTENTIAL (AC = ±8 KV, DC Offset = 0, Sideshields Installed)

| Negative Duty Cycle (%) | Plate Current (μa) | Effective[1] impedance (MΩcm²) | Mean Probe Current (na) | N/S[2] |
|---|---|---|---|---|
| 60 | −186 | 815 | −618 | 0.0202 |
| 60 | −225 | 681 | −740 | 0.0185 |
| 70 | −266 | 573 | −856 | 0.0182 |
| 80 | −298 | 510 | −969 | 0.0197 |
| 90 | −324 | 473 | −1046 | 0.0258 |
| 100 | −320 | 519 | −1146 | 0.0939 |

[1]Effective impedance is the reciprocal of the initial slope of a graph of plate current versus plate voltage, multiplied by the area defined by the emitting corona wire length multiplied by the width of the shell (approximately 234 cm²).

[2]Noise/Signal Ratio is the standard deviation of the scanned probe current divided by the mean crosstrack probe current.

Figure 5:
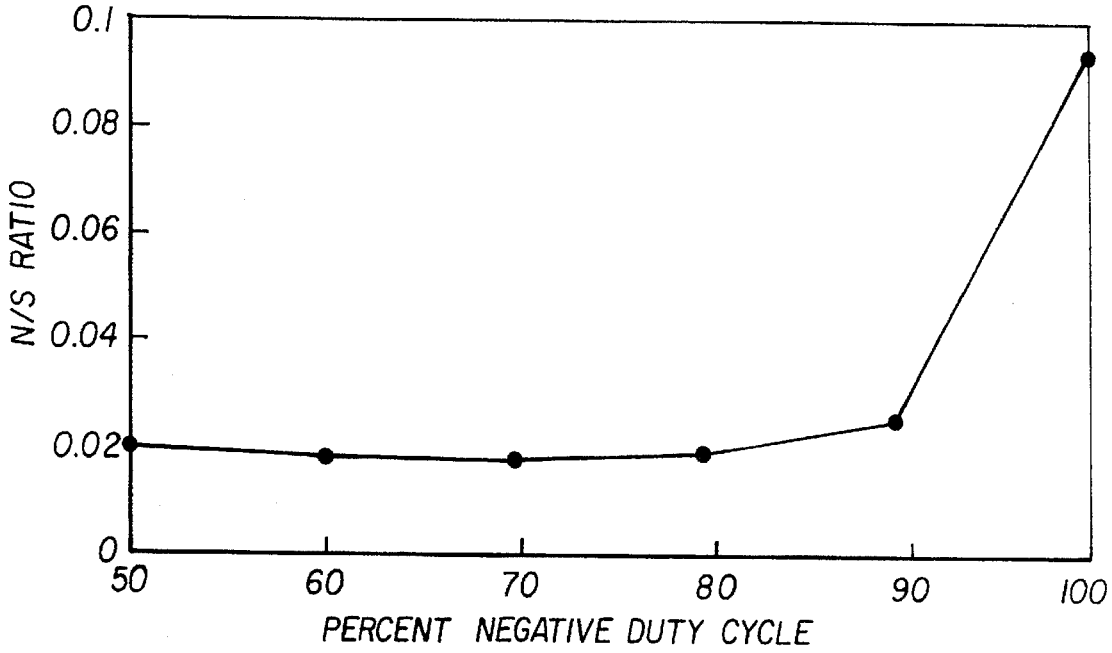
FIG. 5 is a graph of noise-to-signal ratio versus duty cycle.
Figure 6:
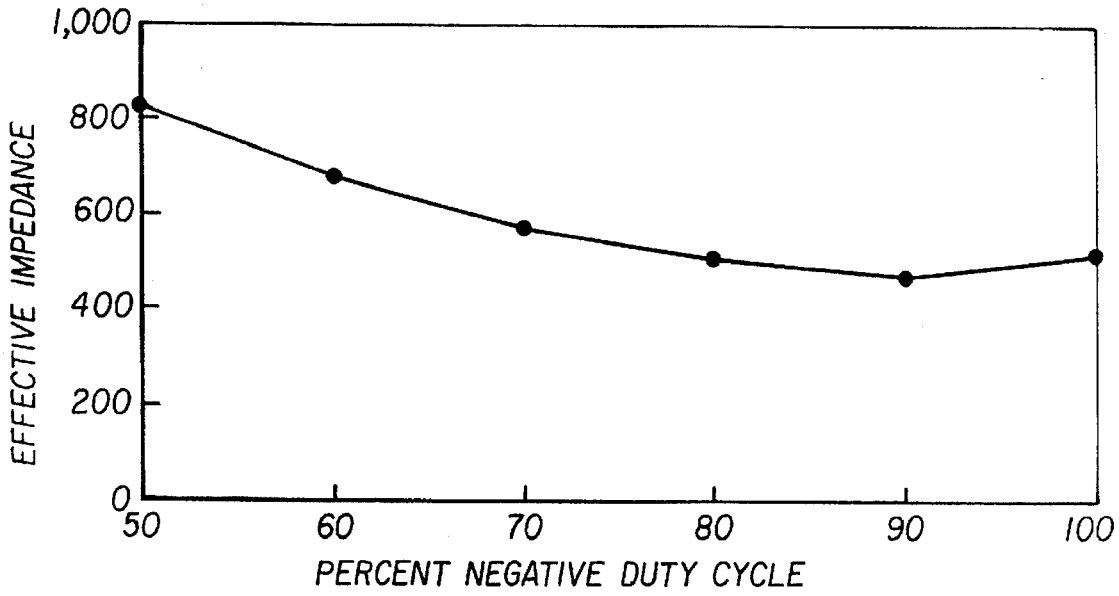
FIG. 6 is a graph of effective impedance versus percent negative duty cycle.
Figure 7:
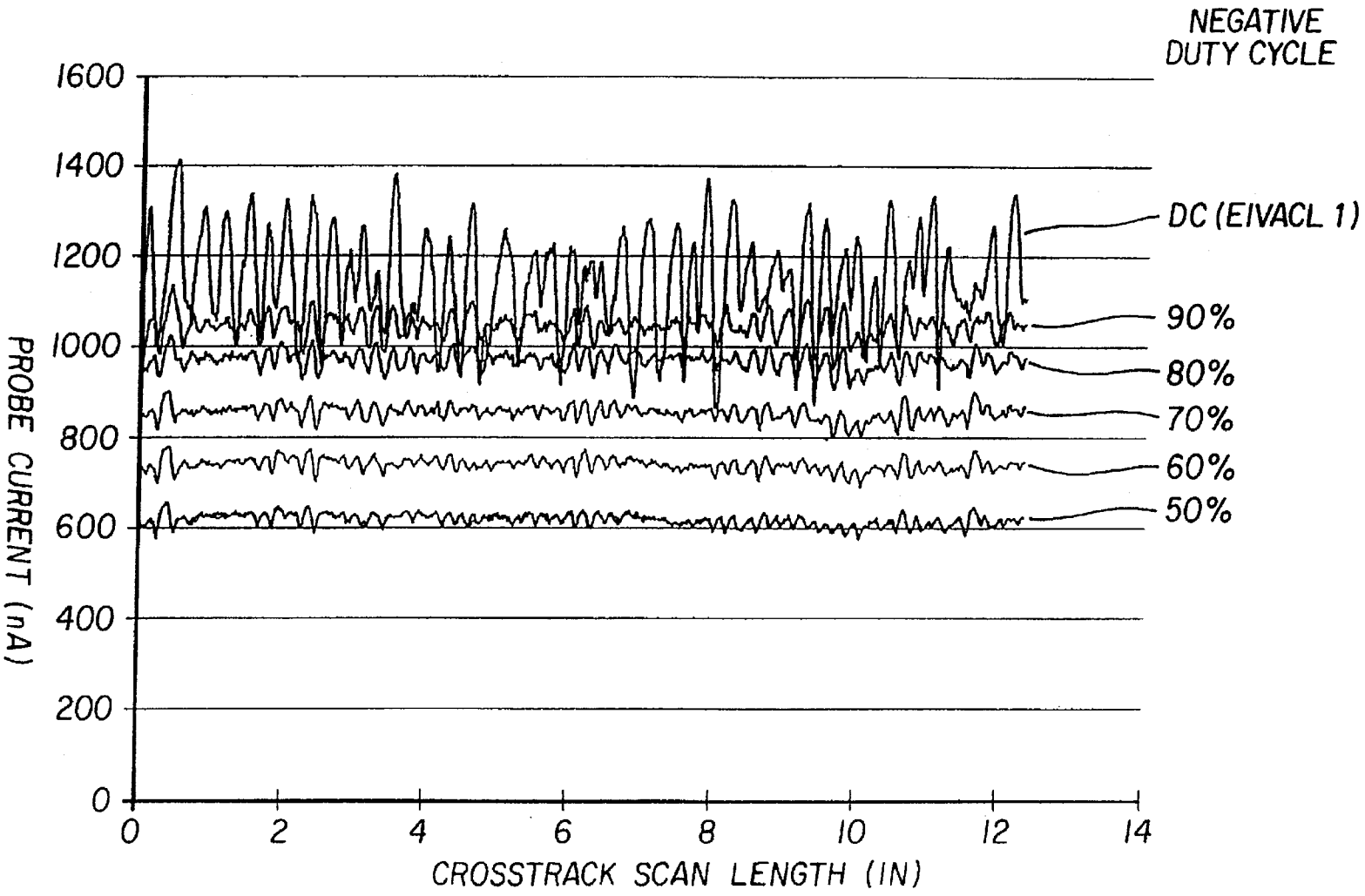
FIG. 7 shows experimental data of probe current versus crosstrack scan length for different duty cycles.

Column 2 of Table 1 shows that the negative current collected at grounded plate electrode 24 increases steadily as the negative duty cycle increases. A similar trend is seen in Column 4 for the mean crosstrack probe current. These increases are reflected by the decrease of the initial effective impedances as duty cycle increases. A charging time constant can be estimated by multiplying the effective impedance, described in footnote 1, by the capacitance per unit area of the photoconductor. Column 5 shows that the crosstrack probe current non-uniformity, expressed as Noise/Signal Ratio, actually declines to a minimum at 70% negative duty cycle and then increases slightly until the duty cycle reaches 90%. However, for 100% duty cycle, the noise-to-signal ratio jumps to a much larger value characteristic of negative DC charging. This is more clearly seen by reference to FIGS. 5, and 6 in which the data of Table 1 are shown in graphical form. FIG. 7 shows the measured scanning probe current versus crosstrack scan length for different negative duty cycles. FIG. 6 shows pictorially the relation between the fluctuations of the scanned currents and the increasing mean currents as duty cycle increases. The almost overlapping data for 50% duty cycle show that in this case the emission nonuniformities are relatively stable spatially, and that "flicker" is relatively small. This example demonstrates that a substantial decrease in charging effective impedance, that is higher efficiency, can be realized at high AC duty cycles, with no accompanying penalty in charging current non-uniformity over duty cycle range of 50% to 90%.

EXAMPLE 2

HIGH DUTY CYCLE YIELDS LOWER POTENTIAL ON WIRE WITH SAME EFFECTIVE CHARGING CURRENT

Figure 8:
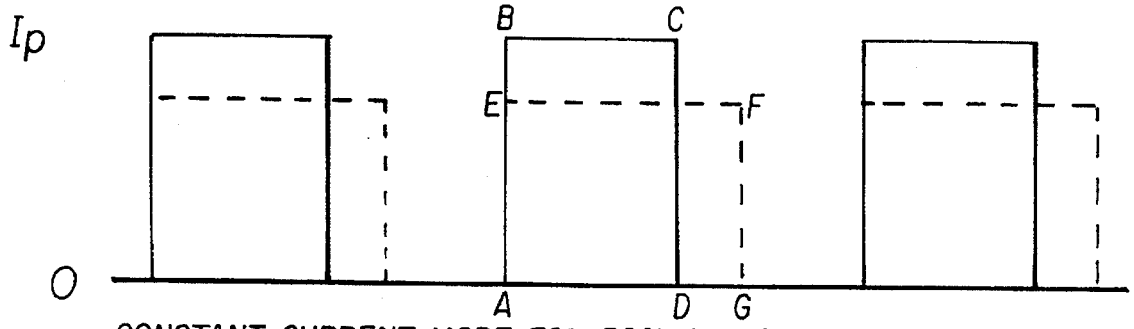
FIG. 8 is a graph of plate current over time.

In this Example, as negative duty cycle was increased, current to the grounded plate electrode was kept approximately constant. The operating conditions for 50% duty cycle were the same as for Example 1, and the same wire set was used. In this constant-current-charging mode (approximately constant effective impedance mode) the peak negative current transmitted by the grid was reduced as the negative duty cycle was increased, so that the time-integrated charging current stayed approximately the same (−185 μa). To achieve this, the peak negative excursion of the wire potential was reduced, see Column 2, as the negative duty cycle was increased from 50% to 90%, thereby reducing the emission current at the wires, and reducing the instantaneous negative current transmitted by the grid. This allowed reductions in corona wire voltage which reduces the possibility of arcing. FIG. 8 illustrates for a hypothetical square wave the reduction in instantaneous plate current arriving at a grounded plate electrode (or an uncharged photoconductor) as duty cycle is increased from 50% to 67%. The areas ABCD and AEFG (current multiplied by time) are the same.

TABLE 2

NEGATIVE CHARGING AT CONSTANT CHARGING CURRENT (DC Offset = 0, V grid = −600 V, Sideshields Installed)

| Negative Duty Cycle (%) | Wire Potential (KV) | Mean Probe Current (na) | N/S |
|---|---|---|---|
| 50 | −7.91 | −584 | 0.0228 |
| 60 | −7.44 | −586 | 0.0344 |
| 70 | −7.21 | −599 | 0.0418 |
| 80 | −7.03 | −606 | 0.0449 |
| 90 | −7.00 | −605 | 0.0617 |
| 100 | −7.13 | −657 | 0.2237 |

For 100% duty cycle, the magnitude of the wire potential actually increased compared to 90%. The shallow minimum at 90% may have been a manifestation of enhanced negative emission just after the positive excursion of the voltage cycle ended and the negative excursion of the voltage cycle began, caused by the existence of a positive space charge and positively charged plastic walls of the charger when the positive excursion ended. The probe currents in Column 3 are not quite constant because each of these currents had to be obtained as an average after each scan which required a pre-estimate of each voltage adjustment. The variations in the mean probe current are not large enough to affect the conclusions of this example. It is seen from Column 4 that the crosstrack non-uniformity of the charging current increases continuously as the negative duty cycle increases. It should be noted that this increase is non-linear, and that the rate of increase gets larger as negative duty cycle increases. Note also that for 100% duty cycle, the crosstrack charging current non-uniformity is very large, 22% compared to 9% in Table 1. It is known that as negative DC corona emission current density decreases (the magnitude of the wire voltage potential decreases), crosstrack non-uniformity increases. It is not obvious that this should also hold true for pulsed negative transmission by the grid from AC emission. In this constant effective impedance mode, a significant reduction of wire potential, almost 900 volts, is achieved as duty cycle is increased from 50% to 80%. By working at lower wire peak voltage, the probability of a wire-to-grid arc is reduced, thereby improving the reliability of the charger. In addition, lower peak voltage may allow the use of a less expensive, more reliable AC corona power supply. For the setpoints in this example, the preferred operation is at 90% duty cycle, at which a substantial decrease of wire potential can be obtained in exchange for a modest penalty in crosstrack uniformity, compared to 50% duty cycle. Nevertheless, at 80% duty cycle, and for the same effective impedance as for negative DC, the crosstrack non-uniformity is decreased from the negative DC value by a factor of 0.2237÷0.0449=5.0, which is a very large improvement.

HIGH DUTY CYCLE WITH DC OFFSET EXAMPLE

EXAMPLE 3

This Example illustrates the effect of holding duty cycle constant at either 50% or 80%, and adding a progressively larger negative DC offset to a ±8.0 KV AC signal in negative AC charging. Adding the negative DC offset results in a smaller magnitude positive excursion and a larger magnitude negative excursion in the total voltage signal applied to the corona wires. The largest DC offset was −2,400 volts, for which the positive excursion was reduced to +5,600 volts and the negative excursion was increased to −10,400 volts. The threshold for positive DC corona emission was lower than +5,600 volts, which means that true AC corona emission behavior was occurring throughout this example.

TABLE 3

EFFECT OF DC OFFSET
(AC = ±8 KV, Sideshields Installed, Grid-to-Plate = 0.060", Vgrid = −600 V)

| Negative Duty Cycle (%) | DC Offset (Volts) | Plate Current (μa) | Effective impedance (MΩcm²) | Mean Probe Current (na) | N/S |
|---|---|---|---|---|---|
| 50 | 0 | −181 | 798 | −599 | 0.0252 |
| 50 | −600 | −230 | 679 | −752 | 0.0229 |
| 50 | −1200 | −272 | 599 | −903 | 0.0179 |
| 50 | −1800 | −318 | 527 | −1057 | 0.0166 |
| 50 | −2400 | −373 | * | −1221 | 0.0156 |
| 80 | 0 | −286 | 538 | −964 | 0.0293 |
| 80 | −600 | −365 | 445 | −1206 | 0.0228 |
| 80 | −1200 | −439 | 388 | −1444 | 0.0192 |
| 80 | −1800 | −507 | 339 | −1689 | 0.0168 |
| 80 | −2400 | −591 | * | −1956 | 0.0192 |
| 100 | 0 | −320 | 527 | −1154 | 0.0865 |

*Not measured

Use of a DC offset increases the propensity of wire-to-grid arcing during one portion of the cycle, and reduces it in the other portion of the cycle. When using a grounded collector, either a plate or a probe, only negative current (pulsed negative) is transmitted by the negative grid. As a result, increasing the negative DC offset increases the time-averaged plate (or probe) current by increasing the peak negative wire voltage. The increased plate current is accompanied by increased negative emission current, resulting in improved crosstrack non-uniformity (N/S ratio). All of the data in Table 3 were measured the same day, but several days after the data of Table 1. The fact that the respective entries for zero DC offset at 50%, 80% and 100% negative duty cycle in each of these tables are different from one another is a reflection of the well-known existence of differing amounts of localized "beading" of the corona emission from the same wires on a day-to-day basis. This variability, especially of the N/S ratio, is normal and can reflect variations in ambient RH, temperature or barometric pressure, as well as experimental error in setting the grid-to-collector spacing. Nevertheless, when entries for the same DC offset are compared in Table 3, it is clear from this Example that noise-to-signal ratio is not sensitive to duty cycle, as also seen in the previous Examples for zero DC offset. This holds for offsets that are large and which are substantial fractions of the peak AC voltage.

HIGH DUTY CYCLE WITH INCREASED GRID TO PHOTOCONDUCTOR SPACING FOR IMPROVED CHARGING RELIABILITY

EXAMPLE 4

This Example shows the benefit of the invention for increased grid-to-collector (grid-to-photoconductor) spacings. It is desirable for robust charger operation that this spacing be not too small, so that the charging current flow is not sensitive to the parallelism between grid and photoconductor, to wire vibrations, nor to positional variations of the surface of the photoconductor, such as "flutter" of photoconductive film belts or film deformations produced by copier standby, e.g. overnight. Equally important, the risk of grid to film arcing is reduced as grid to film spacing is increased. It is well known that as grid-to-photoconductor spacing is increased, the effective impedance of the charger is also increased, i.e., the charging current is decreased. In this Example, increased charger efficiency is traded off for increased reliability by increasing the grid to photoconductor spacing.

TABLE 4

EFFECT OF GRID-TO-COLLECTOR SPACING
(No Sideshields, V grid = −600 V, DC Offset = 0, Wire Set #2)

| Negative Duty Cycle (%) | AC (KV) | Grid-to-Collector (in.) | Mean Probe Current (na) | N/S |
|---|---|---|---|---|
| 50 | ±8.0 | 0.105 | −249.6 | 0.0157 |
| 50 | ±8.0 | 0.090 | −291.9 | 0.0163 |
| 50 | ±8.0 | 0.075 | −336.7 | 0.0185 |
| 50 | ±8.0 | 0.060 | −402.5 | 0.0177 |
| 80 | ±8.0 | 0.105 | −428.7 | 0.0146 |
| 80 | ±8.0 | 0.090 | −492.5 | 0.0152 |
| 80 | ±8.0 | 0.075 | −566.0 | 0.0176 |
| 80 | ±8.0 | 0.060 | −669.9 | 0.0170 |
| 100 | ±8.0 | 0.105 | −454.0 | 0.0474 |
| 100 | ±8.0 | 0.090 | −532.3 | 0.0498 |
| 100 | ±8.0 | 0.075 | −615.1 | 0.0527 |
| 100 | ±8.0 | 0.060 | −732.5 | 0.0566 |
| 50 | ±9.5 | 0.105 | −369.3 | 0.0086 |
| 50 | ±9.5 | 0.090 | −436.4 | 0.0093 |
| 50 | ±9.5 | 0.075 | −523.7 | 0.0098 |
| 50 | ±9.5 | 0.060 | −630.7 | 0.0094 |
| 80 | ±9.5 | 0.105 | −648.7 | 0.0078 |
| 80 | ±9.5 | 0.090 | −756.4 | 0.0072 |
| 80 | ±9.5 | 0.075 | −894.7 | 0.0078 |
| 80 | ±9.5 | 0.060 | −1059.9 | 0.0081 |
| 100 | ±9.5 | 0.120 | −655.9 | 0.0185 |
| 100 | ±9.5 | 0.105 | −763.4 | 0.0142 |
| 100 | ±9.5 | 0.090 | −912.3 | 0.0126 |
| 100 | ±9.5 | 0.075 | −1121.7 | 0.0127 |
| 100 | ±9.5 | 0.060 | −1326.1 | 0.0124 |

In Examples 1 and 2 it was seen that effective impedance declines inversely to increase in the duty cycle. As a result, it is possible to increase both the grid-to-collector spacing and the duty cycle, thereby maintaining a constant effective impedance. The present Example demonstrates this ability for negative charging, and quantifies the resulting crosstrack charging current non-uniformity. For the data in Table 4, new, previously unused wires were employed. The crosstrack charging current non-uniformities were considerably lower for these new wires than for the used wires in previous Examples. In each data block, the AC signal was either ±8.0 KV or ±9.5 KV, and for a given grid-to-collector spacing, e.g., 0.060", the noise-to-signal values in each block are similar to those of Examples 1 and 2, and showed a marked increase in non-uniformity for 100% duty cycle (negative DC) compared to the AC values at 50% and 80% duty cycles. There is also lower crosstrack charging current non-uniformity for the higher AC amplitude, as in Examples 1 and 2. The most important conclusion is that when grid-to-collector spacing was increased, the crosstrack charging current non-uniformity did not change very much, and in fact showed a tendency to decline. In other words, this Example demonstrates that increased charging efficiency at higher duty cycle can be used to offset the increase of effective impedance accompanying increased grid-to-photoconductor spacing in an electrophotographic engine. By employing high duty cycle negative AC charging, e.g. at 80% duty cycle, it is possible to obtain the same effective impedance as a conventional AC charger at 50% duty cycle, while substantially improving the reliability in performance.

HIGH DUTY CYCLE WITH POSITIVE CHARGING AND GROUNDED FLOOR ELECTRODE

EXAMPLE 5

This Example incorporates AC variable duty cycle charging, using an AC signal of ±8.0 KV with no DC offset, grid voltage of +600 V, and grid-to-collector spacing of 0.060". The same charger was used as for Example 1, except that the plastic sideshields were removed, and a grounded floor electrode made from conductive tape was inserted into the bottom of the charger. A new set of wires was used.

TABLE 5

POSITIVE CHARGING AT CONSTANT PEAK POTENTIAL (AC = ±8.0 KV, DC Offset = 0, Grounded Floor Electrode, No Sideshields)

| Positive Duty Cycle (%) | Mean Probe Current (na) | N/S |
|---|---|---|
| 50 | 313.0 | 0.0155 |
| 60 | 388.3 | 0.0165 |
| 70 | 464.0 | 0.0139 |
| 80 | 529.9 | 0.0133 |
| 90 | 624.1 | 0.0142 |
| 100 | 698.7 | 0.0182 |

The effect of the floor electrode was to reduce the onset potential for positive corona emission, thereby keeping the potential of the corona wires low enough to minimize the danger of arcing to the grid, yet allowing useful charging currents to be generated. Despite the enhanced emission due to the grounded floor electrode, the mean scanning probe currents shown in Table 5 are only about half as large as the corresponding negative currents that were obtained using peak AC of ±8.0 KV and Vgrid=−600 V in Example 1. Lower efficiency (higher effective impedance) for positive corona charging compared to negative corona charging is well known, making positive AC charging less attractive than negative AC charging. A somewhat higher AC peak voltage in conjunction with the conductive floor electrode would, of course, generate charging currents competitive with those in Example 1. The important conclusion from Table 5 is that the present invention works well for positive charging. The crosstrack charging current non-uniformity (N/S ratio) declined significantly from its value at 50% positive duty cycle to a minimum near 80% positive duty cycle, before rising again to a higher value at 100% duty cycle (positive DC). It should be noted that there is not an abrupt increase in N/S between 90% and 100%. Such an increase is characteristic of negative AC charging for similar peak voltages, e.g., Example 1. Rather, the transitional behavior for positive charging is similar to the less abrupt transition to negative DC seen for the higher peak voltage in Table 2. This is consistent with experience, that positive DC charging is generally much more uniform than negative DC charging.

HIGH DUTY CYCLE NEGATIVE CHARGING WITHOUT GRID

EXAMPLE 6

In some AC charging applications, it is desirable to use a charger that does not have a control grid between the corona wires and the surface to be charged. This Example demonstrates the utility of the invention for a non-gridded charger with negative AC charging. Table 6 shows results in which a grounded or floating floor electrode was used in conjunction with a small negative DC offset potential. With the floor electrode floating, a condition similar to that produced by an insulating a plastic shell was obtained. The same charger used in Example 5 was employed, including the same wire set, with the grid removed.

TABLE 6

NON-GRIDDED CHARGER (NEGATIVE CHARGING) (No Sideshields, Wire Set #2, Grid/Plate Spacing 0.060")

| Negative Duty Cycle (%) | DC Offset (KV) | AC (KV) | Floor Electrode | Mean Probe Current (na) | N/S |
|---|---|---|---|---|---|
| 50 | −0.6 | ±8 | Floating | −599 | 0.0399 |
| 60 | −0.6 | ±8 | Floating | −858 | 0.0316 |
| 70 | −0.6 | ±8 | Floating | −1114 | 0.0303 |
| 80 | −0.6 | ±8 | Floating | −1392 | 0.0294 |
| 90 | −0.6 | ±8 | Floating | −1682 | 0.0331 |
| 100 | −8.0 | 0 | Floating | −1234 | 0.1483 |
| 50 | −0.6 | ±8 | Grounded | −666 | 0.0390 |
| 60 | −0.6 | ±8 | Grounded | −952 | 0.0317 |
| 70 | −0.6 | ±8 | Grounded | −1253 | 0.0272 |
| 80 | −0.6 | ±8 | Grounded | −1573 | 0.0254 |
| 90 | −0.6 | ±8 | Grounded | −1889 | 0.0274 |
| 100 | −8.0 | 0 | Grounded | −1590 | 0.0905 |

The conclusion drawn from Table 6 is that the behavior of the crosstrack charging current non-uniformity (N/S) for the ungridded charger is similar to that of the gridded charger in Example 1. For either a floating or a grounded floor electrode, crosstrack non-uniformity remains "AC-like" for all the duty cycles listed, i.e., up to at least 90% and markedly lower than the corresponding DC values at 100% duty cycle. It should be noted that the DC controls did not have the same peak negative voltage as did the AC experiments, i.e., −8.0 KV instead of −8.6 KV. As a result, the mean probe currents are smaller than they would have been at the higher potential. Similarly, because the currents are smaller, the N/S values for DC are somewhat higher than they would have been at the higher potential, as discussed above in previous Examples. Nevertheless, it is clear that there would have been an abrupt jump in the N/S values at DC, though somewhat smaller than reported in Table 6. Grounding the floor electrode gives higher charging currents and lower corresponding values of crosstrack charging current non-uniformity than floating the floor electrode. It can be concluded that the invention can be advantageously applied to non-gridded chargers. The preferred embodiment for negative charging using a charger of the type described, having no grid, and with an applied DC offset, is approximately 80% negative duty cycle and a grounded floor electrode.

HIGH DUTY CYCLE WITH A CONDUCTIVE FLOOR

EXAMPLE 7

This Example shows the practice of the invention using a charger having a shell with conducting floor. The procedure and voltages were the same as in Example 1. The same charger was used as in Example 1 except that the sideshields were absent and the shell floor was lined with conducting copper foil, which was grounded. Also, a different set of new wires was used. DC charging with this type of charger is usually carried out using a conducting, rather than an insulating shell. As shown in this Example, the N/S ratio of the negative DC emission current distribution using a conductive floor is considerably smaller (better) than with a plastic shell as shown in Example 1. The N/S values for duty cycles in the range 50%–90% using a plastic shell, as shown in Example 1, Table 1, is better than the N/S ratio for negative DC with a conducting floor as shown in this Example. The present invention, therefore, gives better charging results using a plastic shell at high negative duty cycles than does negative DC charging using a grounded floor electrode. Table 7 shows that the general behavior of the N/S ratio as a function of increasing negative duty cycle using a conducting floor is similar to that with a plastic floor (compare Example 1).

TABLE 7

| Constant Voltage Mode With Grounded Floor Electrode (AC = ±8 KV) | | |
|---|---|---|
| Negative Duty Cycle (%) | Mean Probe Current (na) | N/S ratio |
| 50 | −494 | 0.0182 |
| 60 | −622 | 0.0198 |
| 70 | −732 | 0.0173 |
| 80 | −840 | 0.0170 |
| 90 | −928 | 0.0177 |
| 100 | −964 | 0.0426 |

HIGH DUTY CYCLE WITH CONDUCTIVE SHELL

EXAMPLE 8

Figure 9A:
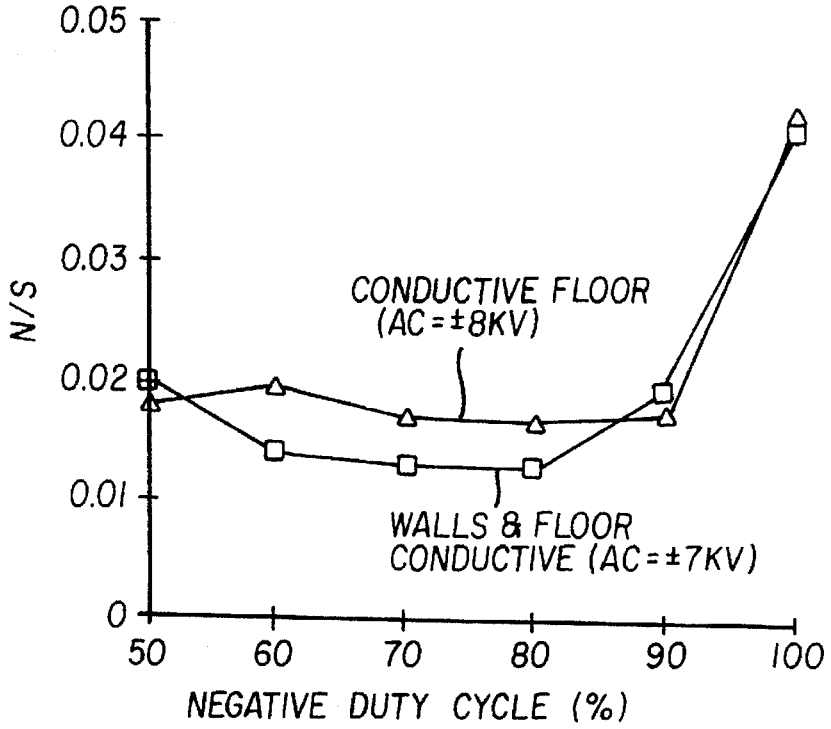
FIG. 9(*a*) shows graphs of noise-to-signal ratio versus negative duty cycle.
Figure 9B:
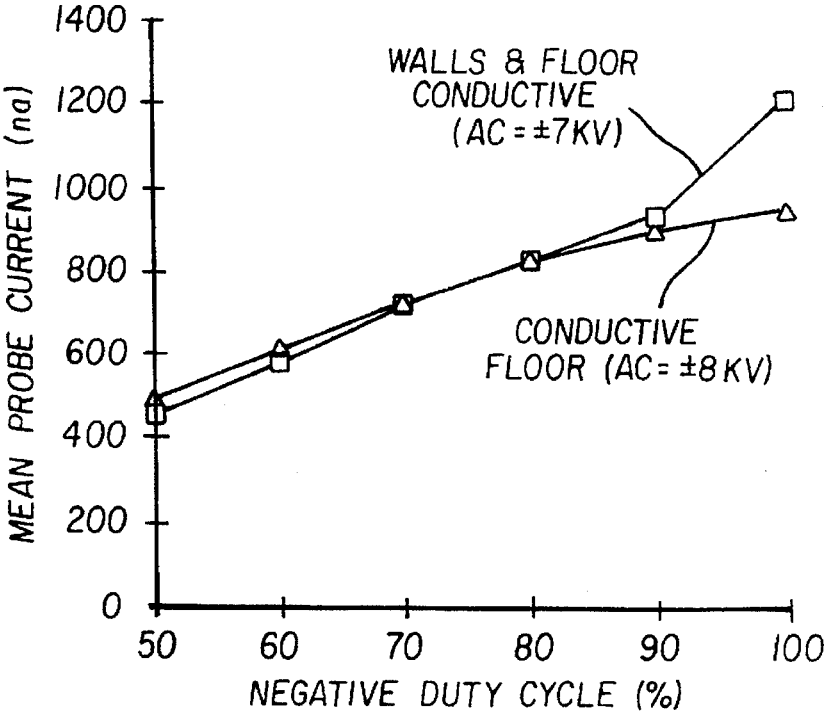

The somewhat lower probe currents with a conductive floor in Example 7, compared with Example 1, are caused by the proximity of the conductive floor electrode, which attracts a larger proportion of the emission current. In the present Example, this is remedied by using grounded, conducting, sidewalls of the plastic shell (sideshields not used), in addition to a grounded, conducting floor, as shown in Table 8. The procedure and wire set were otherwise the same as for Example 7, and voltages were the same except for peak AC voltage. FIGS. 9(*a*) and 9(*b*) show a graphical presentation of the data found in Tables 7 and 8. Even though the peak voltage is smaller in Example 8, it is evident that similar currents (similar impedances) and similar N/S results are obtained with grounded, conducting sidewalls and grounded, conducting floor, as with grounded, conducting floor only (Example 7). It is evident that a fully conductive shell is preferred, because it will give equivalent results using a peak voltage that is approximately 1,000V lower, compared to a grounded floor only.

TABLE 8

| Constant Voltage Mode With Grounded Floor and Grounded Sidewalls (AC = ±7 KV) | | |
|---|---|---|
| 50 | −463 | 0.0197 |
| 60 | −595 | 0.0141 |
| 70 | −727 | 0.0129 |
| 80 | −841 | 0.0132 |
| 90 | −940 | 0.0197 |
| 100 | −1217 | 0.0414 |

By using duty cycle greater than 50%, the invention improves the performance of AC corona charges by reducing the effective impedance and the crosstrack charging current non-uniformity for both a conventional gridded charger (scorotron) and a charger having no grid (corotron). This improvement applies to both positive and negative corona charging, and is particularly useful for negative charging at high negative duty cycle.

Reduced effective impedance at higher duty cycle is advantageous because it allows use of AC chargers at higher process speeds, use of a larger grid-to-photoconductor spacing for reduced sensitivity to non-parallelism of charger and photoconductor, reduced sensitivity to film curl, reduced sensitivity to corona wire vibration, and for reduced propensity for grid-to-photoconductor arcing; and use of a lower voltage on the corona wires at the same charging current (same effective impedance) resulting in lower propensity for wire-to-grid arcing.

Improved crosstrack uniformity from this invention is of general utility in the improvement of image quality in electrophotography. This is especially true as corona wires age. Wire aging generally causes an increase in emission non-uniformity along the wires, often resulting in image imperfections such as streaks and mottle. The invention helps to suppress the severity of these types of image defects, which is important in high fidelity imaging, especially in low density areas of a toner image.

It is possible to take advantage of increased duty cycle by changing the profile of the voltage waveform applied to the corona wires, in order to reduce capacitative currents, sometimes referred to as displacement currents, associated with polarity reversal in the AC cycle. For example, if a trapezoidal waveform is used, a less steep voltage ramp can be employed at with a higher duty cycle. The ramp is the sloping portion of the trapazoided signal. When this is done, the resulting integrated current arriving at the photoconductive element can be maintained or possibly increased as compared to the original steep ramp and 50% duty cycle. The accompanying reduction of the capacitative currents associated with polarity reversal in the AC cycle allows the use of less expensive and more reliable high voltage power supplies for the corona wires.

The invention has been described in detail with particular reference to preferred embodiment thereof, but it will be understood that variations and modifications can be effected within the spirit and scope of the invention as set forth in the claims.

It is to be understood that the invention does not depend on any specific disposition of electrodes, sidewalls or sideshields. The different configurations of these elements described and choices of AC frequency and biases applied to electrodes are intended to illustrate how the invention may be used. In an operating charger the geometrical relationships between the corona wires, grid, electrodes and shell, and spacing between charger and photoconductor depend upon the practical range of potentials that are applied to the corona wires in any particular charger structure.

| PARTS LIST | |
|---|---|
| 1. | 41. |
| 2. | 42. Power supply |
| 3. | 43. |
| 4. | 44. |
| 5. | 45. |
| 6. | 46. |
| 7. | 47. |
| 8. | 48. |
| 9. | 49. |
| 10. AC charger | 50. Power supply |
| 11. Test Apparatus | 51. |
| 12. Corona wires | 52. Generator |
| 13. Second Test Apparatus | 53. |
| 14. Grid | 54. Power supply |
| 15. | 55. |
| 16. Plastic shell | 56. |
| 17. | 57. |
| 18. Plastic sideshields | 58. |
| 19. | 59. |
| 20. Photoconductor | 60. Scanning probe |

-continued

| PARTS LIST | |
|---|---|
| 21. Electrode | 61. |
| 22. Photoconductive Element | 62. |
| 23. Photoconductive Element Support Layer | 63. |
| 24. Plate electrode | 64. |
| 25. Grounded Conductive Electrode Layer | 65. |
| 26. narrow slit | 66. |
| 27. | 67. |
| 28. | 68. |
| 29. | 69. |
| 30. Power supply | 70. |
| 31. | 71. |
| 32. Power supply | 72. |
| 33. | 73. |
| 34. Measure unit | 74. |
| 35. | 75. |
| 36. Computer | 76. |
| 37. | 77. |
| 38. | 78. |
| 39. | 79. |
| 40. Power supply | 80. |

We claim:

1. A corona charger for charging a photoconductor, said charger comprising:

at least one corona wire;

an AC voltage source connected to said corona wire, said AC voltage source having a duty cycle greater than 50% such that a potential on the corona wire is greater than a threshold voltage for corona emission for both positive polarity and negative polarity of the corona wire.

2. A corona charger as in claim 1 wherein said voltage source is a high voltage amplifier driven by a function generator.

3. A corona charger as in claim 1 wherein a shell, partially surrounds said wire, said shell being open in the direction of the photoconductor.

4. A corona charger as in claim 3 wherein a voltage controlled electrode is located between said corona wire and said shell.

5. A corona charger as in claim 3 wherein said shell is nonconductive.

6. A corona charger as in claim 3 wherein said shell is conductive.

7. A corona charger as in claim 1 wherein said duty cycle is less than approximately 90%.

8. A corona charger as in claim 1 further comprising a DC offset voltage source connected to said corona wire.

9. A corona charger as in claim 1 wherein the AC voltage source produces a trapazoidal waveform signal.

10. A corona charger as in claim 9 wherein the trapazoidal waveform has a ramp, a slope of which is shallower at a higher duty cycle than at a lower duty cycle.

11. A corona charger as in claim 1 wherein a voltage controlled grid is located between said corona wire and said photoconductor.

12. A corona charger as in claim 1 wherein said AC voltage source operates at a frequency of greater than 60 Hz.

13. An AC corona charger, for charging a photoconductor comprising:

at least one corona wire;

a voltage controlled grid between said corona wire and a the photoconductor;

means for applying an asymmetric AC voltage waveform to the corona wire, wherein said waveform has a time duration in a first polarity portion of said waveform, greater than a time duration in a second polarity portion of said waveform such that a potential on the corona wire is greater than a threshold voltage for corona emission for both positive polarity and negative polarity of the corona wire.

14. An AC corona charger as in claim 13 further comprising a DC bias voltage source connected to said corona wire.

15. An AC corona charger as in claim 13 wherein said voltage waveform is trapezoidal.

16. An AC corona charger as in claim 13 wherein said voltage waveform is a square wave.

17. An AC corona charger as in claim 13 wherein said voltage waveform has first shape when said voltage waveform has a positive polarity, and said voltage waveform has a second wave shape when said voltage waveform has a negative polarity.

18. A corona charger for charging a photoconductor, said charger comprising:

at least one corona wire;

a voltage controlled grid between said corona wire and said photoconductor;

a voltage source connected to said wire, whereby a corona charge is produced; and a function generator for applying an asymmetrical AC voltage waveform to said wire, wherein said waveform has a duty cycle greater than 50% such that a potential on the corona wire is greater than a threshold voltage for corona emission for both a positive polarity and a negative polarity of the AC voltage waveform.

19. A corona charger as in claim 18 wherein a time integrated AC component of the voltage on the corona wire has an absolute value greater than zero for at least one complete cycle of said AC voltage waveform.

20. A corona charger as in claim 18 wherein said charger further includes a shell partially surrounding said corona wire.

21. In a corona charger for an electrophotographic copying system a method of charging a photoconductor comprising the steps of:

applying an AC voltage signal having a duty cycle greater than 50% and to a corona wire wherein a potential on the corona wire is greater than a threshold voltage for corona emission for both a positive polarity and a negative polarity of the AC voltage signal; and applying a voltage to a grid, located between the corona wire and the phtoconductive.

22. The method as defined in claim 21 wherein said AC voltage signal is an asymmetric waveform.

23. The method as defined in claim 21 further comprising the step of providing a shell partially surrounding said corona wire.

24. A method as in claim 23 further comprising the step of providing an electrode between said shell and said corona wire.

25. A corona charger for charging a photoconductor, said charger comprising:

at least one corona wire;

a shell partially surrounding said wire, said shell being open in the direction of the photoconductor;

an AC voltage source connected to said corona wire for generating an AC waveform, said source having a duty cycle greater than 50%, such that a potential on the corona wire is greater than a threshold voltage for corona emission for both a positive polarity and a negative polarity of the AC waveform, and a time integrated AC component of the AC waveform on the corona wire has an absolute value greater than zero for at least one complete cycle of the AC waveform.

26. An AC corona charger, the improvement therein comprising:

at least one corona wire;

a voltage source for applying an asymmetric AC voltage waveform to the corona wire, wherein said waveform has duration in a first polarity portion of said waveform, greater than a time duration in a second polarity portion of said waveform, wherein a potential on the corona wire is greater than a threshold voltage for corona emission for both a positive polarity and a negative polarity of the corona wire and a time integrated AC component of the voltage on the corona wire has an absolute value greater than zero for at least one complete cycle of the waveform.

27. A corona charger for charging a photoconductor, said charger comprising:

at least one corona wire;

a voltage source to said wire, whereby a corona charge is produced; and means for applying an asymmetrical AC voltage waveform to said wire, wherein said waveform has a duty cycle greater than 50%, wherein a potential on the corona wire is greater than a threshold voltage for corona emission for both a positive polarity and a negative polarity of the AC voltage waveform, and a time integrated AC component of the voltage on the corona wire has an absolute value greater than zero for at least one complete cycle of the waveform.

28. In a corona charger for an electrophotographic copying system a method of charging a phtotconductor comprising the steps of:

applying an AC voltage signal to a corona wire, wherein said AC voltage signal has a duty cycle greater than 50%, and a potential on the corona wire, is greater than a threshold voltage for corona emission for both a positive polarity and a negative polarity of the corona wire and a time integrated AC component of the voltage on the corona wire has an absolute value greater than zero for at least one complete cycle.

29. In a corona charger for an electrophotographic copying system a method of charging a photoconductor comprising the steps of:

applying an AC voltage signal to a corona wire;

adjusting a potential of a grid located between the corona wire and the photoconductor such that a surface potential of the photoconductor, when said photoconductor fully charged, is equal to a first preselected voltage;

setting said AC voltage signal to a preselected duty cycle which is greater than 50%; and setting a potential on the corona wire to a second preselected voltage which greater than a threshold voltage for corona emission for both a positive polarity and a negative polarity of the corona wire.

* * * * *